United States Patent [19]

Morita et al.

[11] Patent Number: 4,644,914

[45] Date of Patent: Feb. 24, 1987

[54] VALVE MECHANISM OF INTERNAL COMBUSTION ENGINE

[75] Inventors: Shuji Morita; Katsujiro Sato, both of Toyota; Yoshio Asaoka, Nishio; Isao Harada, Hekinan; Tomiyasu Hirano, Nishio, all of Japan

[73] Assignees: Toyota Jidosha Kabushiki Kaisha; Odai Tekko Kabushiki Kaisha, both of Aichiken, Japan

[21] Appl. No.: 753,603

[22] Filed: Jul. 10, 1985

[30] Foreign Application Priority Data

Aug. 29, 1984 [JP] Japan ..... 59-129830[U]

[51] Int. Cl.[4] ..... F01L 1/24

[52] U.S. Cl. ..... 123/90.55; 123/90.36; 123/90.44

[58] Field of Search ..... 123/90.44, 90.36, 90.27, 123/90.55, 90.56, 90.57

[56] References Cited

U.S. PATENT DOCUMENTS

| | | | |
|---|---|---|---|
| 1,792,836 | 2/1931 | Handwerker | 123/90.36 |
| 2,011,863 | 8/1935 | Lovett | 123/90.36 |
| 2,634,714 | 4/1953 | Randol | 123/90.55 |
| 3,146,767 | 9/1964 | Dadd | 123/90.36 |
| 3,179,094 | 4/1965 | Ribeton | 123/90.55 |
| 4,192,263 | 3/1980 | Kitagawa | 123/90.44 |
| 4,449,491 | 5/1984 | Tsuchiyama et al. | 123/90.36 |
| 4,497,307 | 2/1985 | Paar et al. | 123/90.36 |
| 4,523,551 | 6/1985 | Anai et al. | 123/90.36 |
| 4,554,895 | 11/1985 | Ono | 123/90.55 |

FOREIGN PATENT DOCUMENTS

| | | | |
|---|---|---|---|
| 23250 | 2/1981 | European Pat. Off. | 123/90.36 |
| 752332 | 9/1933 | France | 123/90.36 |
| 51907 | 4/1980 | Japan | 123/90.44 |
| 23010 | 2/1984 | Japan | 123/90.36 |

*Primary Examiner*—Ira S. Lazarus

*Attorney, Agent, or Firm*—Parkhurst & Oliff

[57] ABSTRACT

A hydraulic valve lifter is held in the recess of the rocker arm swingably pivoted to the rocker shaft. An oil pressure chamber is formed between the lifter body and the plunger. An oil chamber to supply the oil to the oil pressure chamber is formed between the plunger and the recess. An oil supply path to supply the oil through the oil path of the rocker shaft communicates to the oil chamber. A return path is provided extending from the top of the oil chamber to a clearance between the inside of the rocker arm hole and the outside of the rocker shaft or to a clearance between the outside of the lifter body and the inside of the rocker arm recess. With this arrangement of the device, the air infiltrating the oil chamber can be discharged from the top of the oil chamber via the return path and the clearance, thereby preventing invasion of the air into the oil pressure chamber and ensuring normal functioning of the hydraulic valve lifter.

21 Claims, 8 Drawing Figures

VALVE MECHANISM OF INTERNAL COMBUSTION ENGINE

BACKGROUND OF THE INVENTION

1. Field of the Invention

The present invention relates to a rocker arm with a built-in hydraulic valve lifter for installation in the valve system of an internal combustion engine.

2. Description of the Prior Art

A well-known valve mechanism of an internal combustion engine is designed such that a rocker arm is pivotably connected to the rocker shaft and a cam engages one end of the rocker arm. The cam pivots the rocker arm so that the other end of the rocker arm operates the suction and exhaust valves.

In such a valve mechanism the rocker arm is provided with a built-in hydraulic valve lifter so that the gap created between the suction and exhaust valves and the rocker arm on account of the expansion/contraction of the suction and exhaust valves due to temperature fluctuations and the abrasive wear of the driving parts may be automatically absorbed, thereby maintaining a zero lash between the suction and exhaust valves and the rocker arm. The hydraulic valve lifter includes a lifter body with a slidable plunger inserted into a recess formed on the rocker arm. An oil chamber is defined between the recess and the plunger. An oil pressure chamber is defined between the plunger and the lifter body. A check valve is installed in a passage between the oil chamber and the oil pressure chamber to prevent a back flow of the oil from the oil pressure chamber into the oil chamber. An oil supply path for supplying the oil to the oil chamber runs through the rocker arm, and extends from the oil hole of the rocker shaft to the oil chamber of the hydraulic valve lifter.

In the conventional rocker arm with such a built-in hydraulic valve lifter, while the engine is not working and there is no supply of the oil from the oil pump, the suction path of the engine and the oil path of the rocker shaft are filled with air instead of oil. Therefore, when the engine is working and particularly when it starts, the air in the oil or the air filling the oil path flows with the oil into the oil chamber of the hydraulic valve lifter.

If the air in the oil chamber has no escape provided for it, then the air may go into the oil pressure chamber. If the air goes into the oil pressure chamber, the lifter body will have an erratic motion, resulting in a failure of the hydraulic valve lifter to perform its normal function.

SUMMARY OF THE INVENTION

An object of the present invention is to provide a mechanism for the rocker arm with a built-in hydraulic valve lifter that it is capable of permitting the air contained in the oil supplied to the oil chamber of the hydraulic valve lifter or the air filling the oil supply path, when the engine is working, and particularly when it starts, to escape out of the oil chamber, thereby preventing possible entry of the air into the oil pressure chamber of the hydraulic valve lifter.

To accomplish this object, the valve mechanism of the internal combustion engine according to the present invention includes a hydraulic valve lifter assembled in the recess of the rocker arm pivotably connected to the rocker shaft. The hydraulic valve lifter includes a cylindrical lifter body, a plunger which is slidably inserted into the lifter body, thereby constituting an oil chamber between the recess and said plunger and an oil pressure chamber between the lifter body and the plunger, and a check valve which can block a hole for providing communication between the oil chamber with the oil pressure chamber. An oil supply path is formed in the rocker arm, and extends from the oil path in the rocker shaft via the oil hole of the rocker shaft up to the oil chamber. A return path is formed in the rocker arm and leads from the top of the oil chamber either to a clearance between the inside of the hole of the rocker arm and the outside of the rocker shaft or to a clearance between the outside of the lifter body and the inside of the recess.

In the above-mentioned mechanism, the return path will be easy to form, if the return path is designed to include a first passage communicating with the top of the oil chamber and a second passage arranged at nearly 90° to the first passage and communicating with the clearance.

The clearance may be designed such that it is partially enlarged at a position where it communicates with the return path.

In the valve mechanism of the above-mentioned internal combustion engine, when the engine works and the oil pump starts, the oil goes into the oil chamber of the hydraulic valve lifter via the oil path of the rocker shaft, the oil hole of the rocker shaft and the oil path. Therefore, the air in the oil supply system flows together with the oil into the oil chamber. The air which has gone into the oil chamber will collect in the top of the oil chamber by its buoyancy, but the air as well as the oil will flow into the return path, which communicates to the top of the oil chamber. The return path communicates either to the clearance between the rocker arm and the rocker shaft or to the clearance between the lifter body and the rocker arm recess. The clearance may extend beyond the rocker arm. Accordingly the air which has gone into the return path will be gradually discharged together with the oil through the clearance and out of the rocker arm. Thus, with no collection of the air in the oil chamber of the hydraulic valve lifter, air infiltration into the oil pressure chamber can be prevented, thereby ensuring the normal functioning of the hydraulic valve lifter.

If the clearance is partially enlarged, the oil flow within the return path or at the clearance will be facilitated even when the oil has a high viscosity at, say, cold start of the engine, and the air will be easily discharged out of the oil chamber with the oil flow. Thus the air which has infiltrated into the oil chamber can be discharged faster and more positively.

BRIEF DESCRIPTION OF THE DRAWINGS

The above object, features and advantages of the present invention will become apparent and more readily appreciated from the following detailed description of exemplary embodiments of the present invention, taken in conjunction with the accompanying drawings, wherein.

DETAILED DESCRIPTION OF THE PREFERRED EMBODIMENTS

Figure 1:
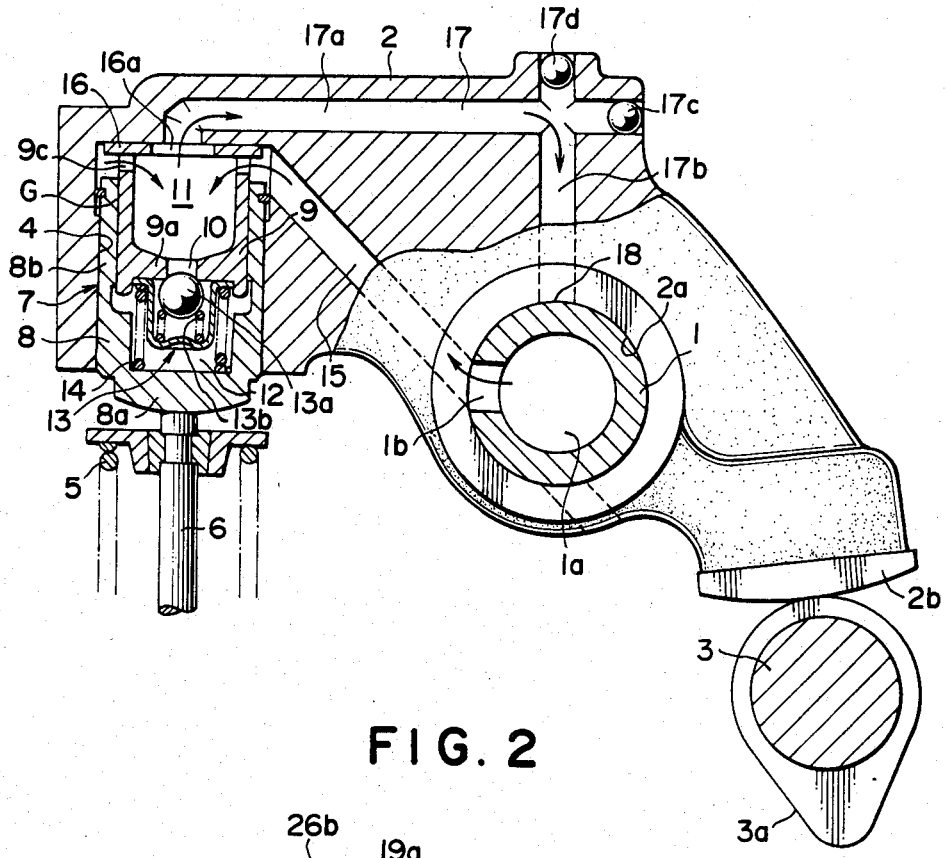
FIG. 1 is a cross-sectional view of a valve mechanism of the internal combustion engine in accordance with an embodiment of the present invention.

In FIG. 1 illustrating one embodiment of the present invention, the valve mechanism includes a rocker shaft 1 with an oil path 1*a* internally running in the axial direction and a rocker arm 2 swingably pivoted to the rocker shaft 1.

One end of the rocker arm 2 slidably engages a cam 3*a* fitted to a cam shaft 3, the other end of the arm 2 having a recess 4 formed therein. The recess 4 holds the hydraulic valve lifter 7 engaging the head of a suction valve or an exhaust valve 6 urged upward by a valve spring 5.

The hydraulic valve lifter 7 is equipped with a cylindrical lifter body 8 having a bottom 8*a*. The lifter body 8 with its bottom 8*a* slides or rotates in the recess 4 of the rocker arm 2. A plunger 9 with a through hole 10 opening at its bottom 9*a* is inserted slidably into to cylindrical part 8*b* of the lifter body 4. The cavity formed between the plunger 9 and the recess 4 of the rocker arm 2 constitutes the oil chamber 11, while the cavity formed between the lifter body 8 and the plunger 9 constitutes the oil pressure chamber 12. The oil pressure chamber 12 is equipped with a check valve 13 to block the through hole 10. The check ball 13*a* of the check valve 13 is urged by the check ball spring 13*b* to block the through hole 10. The check valve 13 serves to prevent a back flow of the oil from the oil pressure chamber 12 via the through hole 10 into the oil chamber 11. The oil pressure chamber 12 is equipped with the return spring 14, which acts to press the lifter body 8 against the valve 6.

The rocker arm 2 has an oil supply path 15 which runs from the oil hole 1*b* of the rocker shaft 1 to the top of the oil chamber 11. When the oil flows into the oil chamber 11 via the oil path 1*a* of the rocker shaft, the oil hole 1*b* and the oil supply path 15, the oil goes into the oil chamber 11 through several grooves 9*c* provided in the plunger 9.

A plate 16 is installed between the end wall of the recess 4 of the rocker arm 2 and the top end of the plunger 9. At the top of the rocker arm 2 extends a return path 17, one end of which leads to the oil chamber 11 via the hole 16*a* provided in the plate 16.

In this embodiment, the return path 17 includes the first passage 17*a* leading to the top of the oil chamber 11 and the second passage 17*b* extending at about 90° to the first passage 17*a*. One end of the second passage 17*b* communicates with a clearance 18 between the inside of the hole 2*a* of the rocker arm 2 and the outside of the rocker shaft 1. The width of the clearance 18 is usually several tens of microns.

The first passage 17*a* is located above the hole 16*a* of the plate 16 even when the end 2*b* of the rocker arm 2 is not in contact with the cam 3*a*. The first passage 17*a* extends from the outside of the rocker arm 2 and its end opposite to the side of the oil chamber 11 is sealed with a blind ball 17*c*. The second passage 17*b* also extends from the outside of the rocker arm 2 and its end opposite to the side of the clearance 18 is sealed with a blind ball 17*d*. The blind balls 17*c*, 17*d* are provided as blind means for sealing the ends of the passages.

In this embodiment, the return path 17 includes the first passage 17*a* and the second passage 17*b* intersecting each other roughly at a right angle, but any variation is possible, provided the path 17 runs from the top of the oil chamber 11 to the clearance 18.

In the device described above, when the engine starts, the cam shaft 3 also rotates and the cam 3*a* causes the rocker arm 2 to swing around the rocker shaft 1. At the same time the oil pump is driven with the operation of the engine. The oil pumped by the oil pump flows into the oil supply path 15 of the rocker arm 2 via the oil path 1*a* and the oil hole 1*b* of the rocker shaft 1 and is supplied to the oil chamber 11 of the hydraulic valve lifter 7.

When the cam 3*a* pushes against the end 2*b* of the rocker arm 2, the bottom 8*a* of the lifter body 8 of the hydraulic valve lifter 7 pushes the valve 6 down against the urging force of the valve spring 5. The oil in the oil pressure chamber 12 of the hydraulic valve lifter 7 is then pressurized to shut the check valve 13. Therefore, no oil flows out of the through hole 10 of the oil pressure chamber 12, but a very small amount of oil flows through a gap G between the cylindrical part 8*b* of the lifter body 8 and the plunger 9 and goes into the oil chamber 11, thereby causing a slight contraction of the hydraulic valve lifter 7.

When the cam 3*a* rotates further and detaches itself from one end of the rocker arm 2, the lifter side of the rocker arm 2 rises, being pushed up by the valve 6. Then the lifter body 8 is pushed down by the return spring 14 and in consequence the oil pressure in the oil pressure chamber 12 becomes lower than the oil pressure in the oil chamber 11. Thereupon the check valve 13 opens to permit the oil in the oil chamber 11 to flow into the oil pressure chamber 12, thereby compensating for the loss of the oil in the oil pressure chamber 12. Meanwhile, the oil in the oil chamber 11 flows from the hole 16*a* of the plate 16 to the return path 17 and leaks out through the clearance 18 between the hole 2*a* of the rocker arm 2 and the rocker shaft 1. Thus the oil in the oil chamber 11 is circulated little by little.

When the engine stops, the oil in the rocker shaft 1 as well as the oil in the oil supply path 15 drains to the outside. In consequence the oil in the top position of the oil chamber 11 located above the groove 9*c* of the plunger 9 as well as the oil in the return path 17 drains and is replaced with the air.

When the engine is started in this state, the air filling the oil path 1*a*, the oil hole 1*b* of the rocker shaft 1 and the air in the oil supply path 15 and the oil chamber 11 are replaced with the oil. The air remaining in the top of the oil chamber 11 or in the first passage 17*a* of the return path 17 as well as the air sent from the oil supply path 15 into the oil chamber 11 by an incoming oil is pushed toward the second passage 17*b* by the oil coming into the first passage 17*a* from the oil chamber 11. The oil together with the air will be swiftly discharged through the clearance 18 between the hole 2*a* of the rocker arm 2 and the rocker shaft 1 via the second passage 17*b*. In this manner, the air collecting in the oil chamber 11 of the hydraulic valve lifter 7 when the engine stops will be swiftly driven out via the return path 17 by an incoming flow of the oil through the oil path 1*a* of the rocker shaft 1 at the start of the engine, with no possibility of the air invading from the oil chamber 11 into the oil pressure chamber 12.

Figure 2:
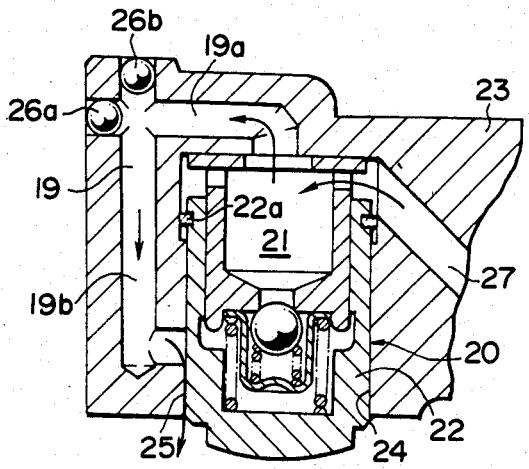
FIG. 2 is a partial cross-sectional view of a valve mechanism of the internal combustion engine in accordance with another embodiment of the present invention.

FIG. 2 illustrates another embodiment of the present invention. In this embodiment, the return path 19 runs from the top of the oil chamber 21 of the hydraulic valve lifter 20 to a clearance 25 between the outside of the lifter body 22 and the inside of the recess 24 of the rocker arm 23.

Similarly to the first embodiment, the return path 19 includes the first passage 19*a* and the second passage 19*b* intersecting each other roughly at right angles. One end of the second passage 19*b* communicates with the clearance 25 at a position which is closer to the outside of the rocker arm 23 than to the seal ring 22*a* attached to the outside of the lifter body 22 for sealing the gap between the lifter body 22 and the recess 24. That is, the seal ring 22*a* is located adjacent an innermost portion of the recess, while the second passage 19*b* communicates with the clearance at a location adjacent an outermost end of the recess. The ends of the passages 19*a*, 19*b* are sealed with blind balls 26*a*, 26*b*. The blind balls 26*a*, 26*b* are provided as blind means for sealing the ends of the passages.

In this embodiment, the oil which has been delivered to the oil chamber 21 of the hydraulic valve lifter 20 via the oil supply path 27 at engine start will flow through the first return passage 19*a* and then the second return passage 19*b*, to be discharged out of the rocker arm 23 through the clearance 25 between the recess 24 and the lifter body 22. The air which may remain in the oil chamber 21 will be discharged out of the rocker arm 23 through the same path as the oil is discharged.

Next will be discussed the case of providing a partial enlargement in the part of the clearance which communicates with the return path. In this case, just as in the above two embodiments, the air escape path is provided by installation of the return paths 17, 19. However, in a case with a narrow clearance and at low temperature, particularly when the rise in temperature is not sufficient at engine start, it is likely to take long time for the air to escape if the oil stands in the way of the air escape path, usually because the oil is highly viscous at low temperatures associated with engine start. An enlarged part in the clearance will facilitate the escape of both the oil and the air; thus it will positively help the escape of the air in the oil and the air in the oil supply path.

Figure 3:
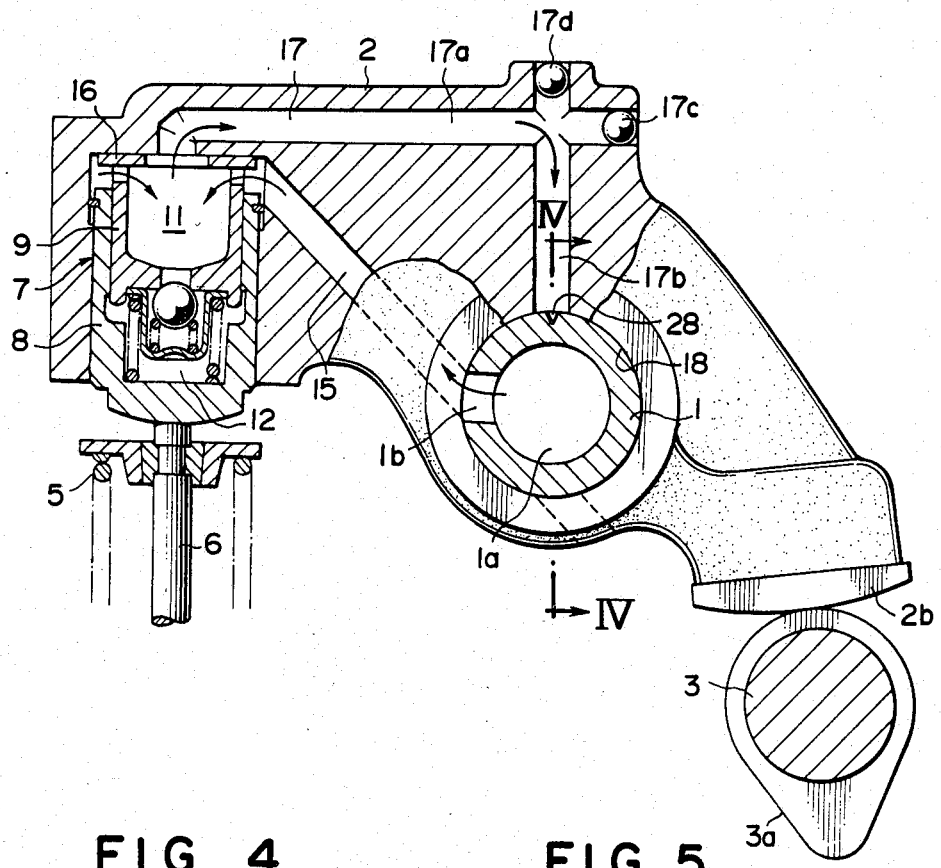
FIG. 3 is a cross-sectional view of the valve mechanism in FIG. 1 with a groove provided at its clearance.
Figure 4:
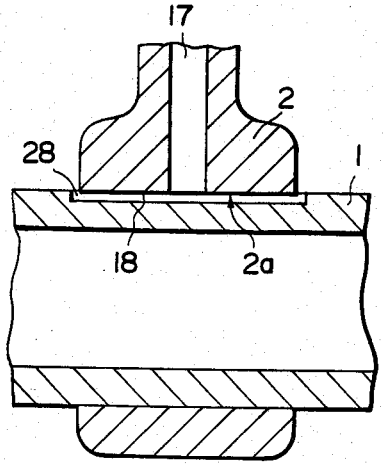
FIG. 4 is a partial cross-sectional view taken along line IV—IV of the device in FIG. 3.
Figure 5:
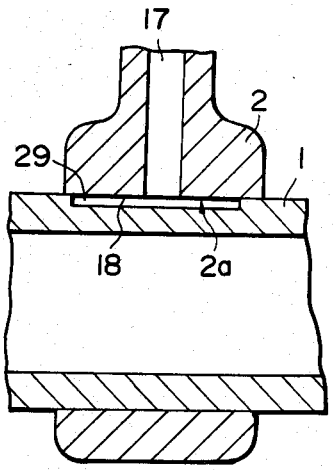
FIG. 5 is a cross-sectional view along the same line IV—IV of the device in FIG. 3 with a different design for the groove.
Figure 6:
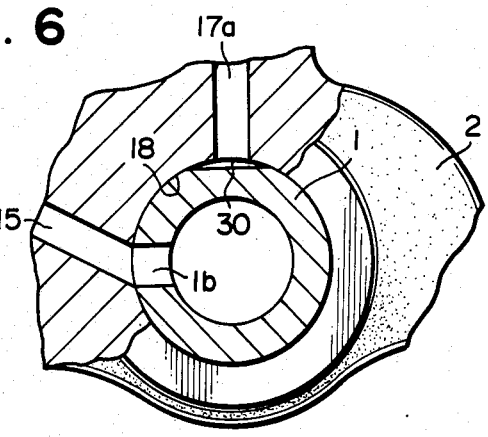
FIG. 6 is a cross-sectional view of the junction between the rocker shaft and the rocker arm when a partial notch is provided on the outside of the rocker shaft in the device illustrated in FIG. 1.

An example of the enlarged clearance is illustrated in FIG. 3, in which the clearance 18 in the device shown in FIG. 1 is provided with an enlarged part 28. In this embodiment, the enlarged part 28 is a V-groove cut on the outside of the rocker shaft 1. The V-groove 28, as seen from FIG. 4, extends parallel to the axis of the rocker shaft 1 and opens outward to an extent slightly beyond both sides of the rocker arm 2. As shown in FIG. 5, the V-groove 29 may be designed such that it stops just short of leading out of the rocker arm, thereby limiting the volume of the oil escaping through the V-groove 29. Variations are possible: the V-grooves 28, 29 may be provided on the inside of the hole 2*a* of the rocker arm 2 and the grooves may be designed in sections other than V-shape. Further, any means other than the groove may be adapted, provided it assures a partial enlargement of the clearance 18. FIG. 6 illustrates an example of another selection, in which the outside of the rocker shaft 1 is partially notched to form an enlarged clearance 30 extending like the V-grooves 28, 29 in a direction parallel to the axis of the rocker shaft 1.

Figure 7:
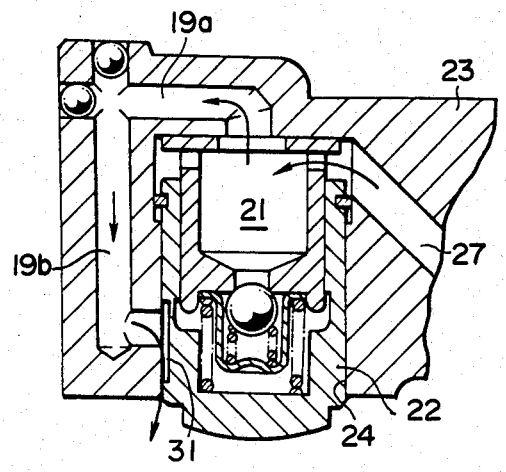
FIG. 7 is a partial cross-sectional view of the device in FIG. 2 with a groove provided at its clearance.
Figure 8:
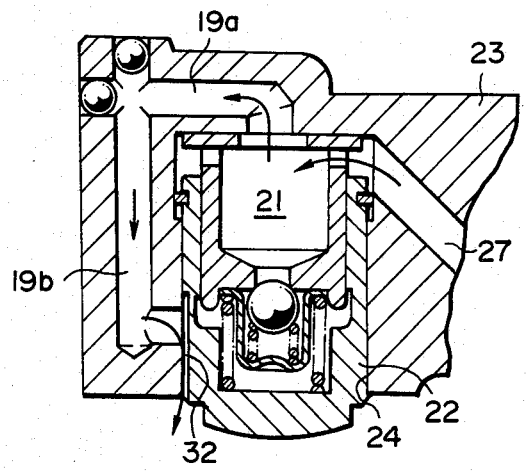
FIG. 8 is a partial cross-sectional view of the drive in FIG. 7 with the groove extended.

When an enlarged part is provided in the clearance 25 of the device illustrated in FIG. 2, the enlarged part can be one as shown in FIGS. 7 and 8. Namely, an enlarged clearance 31 (FIG. 7) extending downward can be provided either in the recess 24 of the rocker arm 23 or on the outside of the lifter body 22. The clearance 31 may be a groove or a notch. An enlarged clearance 32 (FIG. 8) may be extended to a position where the rocker arm 23 communicates to the outside, depending on the volume of the oil escaping out of the rocker arm 23, or it may be terminated just short of such a position. Installation of the enlarged clearances 28, 29, 30, 31, 32 will increase the area of the oil flow path and accordingly will help the oil escape out of the rocker arm, even when the oil viscosity is high at low temperatures. Thus, with both the air and the oil provided with an escape path, the air which has infiltrated into the oil chamber will be positively discharged in short time.

When the enlarged clearances 29, 30, 31 are designed to terminate just short of communicating to the outside, the oil flow will be limited at the termination point and it will be possible to release only the air without releasing a large quantity of oil.

As described above, the present invention can prevent infiltration of the air into the oil pressure chamber and thus it can guarantee the normal functioning of the hydraulic valve lifter.

Although only preferred embodiments of the present invention have been described in detail, it will be appreciated by those skilled in the art that various modifications and alterations can be made to the particular embodiments shown without materially departing from the novel teachings and advantages of the invention. Accordingly, it is to be understood that all such modifications and alterations are included within the scope of the invention as defined by the following claims.

What is claimed is:

1. A valve mechanism of an internal combustion engine, said valve mechanism comprising:

a hydraulic valve lifter assembled in a recess of a rocker arm pivotably connected to a rocker shaft, said shaft extending through a hole in said rocker arm, said hydraulic valve lifter having a lifter body slidably inserted in said recess, a plunger slidably inserted in said lifter body, an oil chamber formed between said recess and said plunger, an oil pressure chamber communicating with said oil chamber through a passage and formed between said lifter body and said plunger, and a check valve located in said passage for providing selective communication between said oil chamber and said oil pressure chamber;

an oil supply path formed in said rocker arm and extending from an oil path formed in said rocker shaft to said oil chamber; and a return path formed in said rocker arm and communicating with said oil path in said rocker shaft, said return path extending from the top of said oil chamber to a clearance between an inside of the hole of said rocker arm and an outside of said rocker shaft, said return path providing constant communication between said oil chamber and said clearance.

2. The valve mechanism of the internal combustion engine of claim 1, wherein said return path includes a first passage conmunicating with the top of the oil chamber and a second passage communicating with said clearance, said second passage being located at an angle of about 90° relative to said first passage .

3. The valve mechanism of the internal combustion engine of claim 2, wherein said first passage and said second passage each have an opening communicating with an outside of said rocker arm, said openings of said first passage and said second passage to the outside being blocked with blind means.

4. The valve mechanism of the internal combustion engine of claim 3, wherein said blind means is a blind ball.

5. The valve mechanism of the internal combustion engine of claim 1, wherein said clearance is provided with a partial enlargement at a portion of said clearance which communicates with said return path.

6. The valve mechanism of the internal combustion engine of claim 5, wherein said partial enlargement is a groove located on one of an inside surface of said hole for the rocker arm, and an outside surface of said rocker shaft.

7. The valve mechanism of the internal combustion engine of claim 5, wherein said partial enlargement is a partial notch on the outside surface of said rocker shaft.

8. The valve mechanism of the internal combustion engine of claim 5, wherein said partial enlargement has a length sufficient to provide communication with an outside of said rocker arm.

9. The valve mechanism of the internal combustion engine of claim 5, wherein said partial enlargement is located within said rocker arm.

10. The valve mechanism of the internal combustion engine of claim 1, wherein a plate is interposed between said plunger and said recess, said plate having a hole which provides communication between said oil chamber and said return path.

11. A valve mechanism of an internal combustion engine, said valve mechanism comprising:

a hydraulic valve lifter assembled in a recess of a rocker arm pivotably connected to a rocker shaft, said shaft extending through a hole in said rocker arm, said hydraulic valve lifter having a lifter body slidably inserted in said recess, a plunger slidably inserted in said lifter body, an oil chamber formed between said recess and said plunger, an oil pressure chamber communicating with said oil chamber through a passage and formed between said lifter body and said plunger, and a check valve located in said passage for providing selective communication between said oil chamber and said oil pressure chamber;

an oil supply path formed in said rocker arm and extending from an oil path formed in said rocker shaft to said oil chamber; and a return path formed in said rocker arm and communicating with said recess, said return path extending from the top of said oil chamber to a clearance between an outside surface of said lifter body and an inside surface of said recess, said return path providing constant communication between said oil chamber and said clearance.

12. The valve mechanism of the internal combustion engine of claim 11, wherein said return path includes a first passage communicating with the top of the oil chamber and a second passage communicating with said clearance, said second passage being located at an angle of about 90 ° relative to said first passage.

13. The valve mechanism of the internal combustion engine of claim 12, wherein said first passage and said second passage each have an opening communicating with an outside of said rocker arm, said openings of said first and second passages to the outside being blocked with blind means.

14. The valve mechanism of the internal combustion engine of claim 13, wherein said blind means is a blind ball.

15. The valve mechanism of internal combustion engine of claim 11, wherein said clearance is provided with a partial enlargement at a portion of said clearance which communicates with said return path.

16. The valve mechanism of the internal combustion engine of claim 15, wherein said partial enlargement is a groove located on one of an outside surface of said lifter body and an inside surface of said recess.

17. The valve mechanism of the internal combustion engine of claim 15, wherein said partial enlargement is a partial notch on the outside surface of said lifter body.

18. The valve mechanism of the internal combustion engine of claim 15, wherein said partial enlargement has a length sufficient to provide communication with an outside of said rocker arm.

19. The valve mechanism of the internal combustion engine of claim 15, wherein said partial enlargement is located within said rocker arm.

20. The valve mechanism of the internal combustion engine of claim 11, wherein a plate is interposed between said plunger and said recess, said plate having a hole which provides communication between said oil chamber and said return path.

21. The valve mechanism of the internal combustion engine of claim 11, wherein a seal ring is provided on the outside of said lifter body for sealing a gap between said lifter body and said recess, said seal ring being located adjacent and innermost portion of said recess, said return path communicating with said clearance at a location adjacent an outermost portion of said recess such that said return path is closer to the outside of said rocker arm than said seal ring.

* * * * *